US010159983B2

(12) United States Patent
Loke et al.

(10) Patent No.: US 10,159,983 B2
(45) Date of Patent: Dec. 25, 2018

(54) REPLACEMENT CONE CRUSHER WEAR LINERS

(71) Applicant: YOONSTEEL (M) SDN. BHD., Ipoh, Perak (MY)

(72) Inventors: Yoon Chee Loke, Ipoh (MY); Toong Seng Choy, Ipoh (MY); Chen Seong Leong, Ipoh (MY)

(73) Assignee: YOONSTEEL (M) SDN. BHD., Ipoh, Perak (MY)

( * ) Notice: Subject to any disclaimer, the term of this patent is extended or adjusted under 35 U.S.C. 154(b) by 53 days.

(21) Appl. No.: 15/061,568

(22) Filed: Mar. 4, 2016

(65) Prior Publication Data

US 2016/0288128 A1 Oct. 6, 2016

(30) Foreign Application Priority Data

Mar. 30, 2015 (MY) ..... PI 2015701018

(51) Int. Cl.
*B02C 2/00* (2006.01)

(52) U.S. Cl.
CPC ..... *B02C 2/005* (2013.01)

(58) Field of Classification Search
CPC ..... B02C 2/005
USPC ..... 241/207–216
See application file for complete search history.

(56) References Cited

U.S. PATENT DOCUMENTS 2,341,544 A * 2/1944 Gruender ..... B02C 2/005 241/207
2,703,297 A 3/1955 MacLeod
2,970,775 A * 2/1961 Chapman ..... B02C 2/005 238/DIG. 1
2,970,783 A * 2/1961 Cheyette ..... B02C 2/005 238/DIG. 1
RE25,233 E * 8/1962 Broman ..... B02C 2/005 241/299
3,503,564 A * 3/1970 Adam ..... B02C 2/005 241/299
3,565,354 A 2/1971 Gittings
3,682,227 A * 8/1972 Motz ..... B02C 2/005 164/94
4,232,833 A * 11/1980 Werginz ..... B02C 2/047 241/207
5,516,053 A * 5/1996 Hannu ..... B02C 2/005 241/207

(Continued)

FOREIGN PATENT DOCUMENTS

WO 2014/072136 5/2014

*Primary Examiner* — Faye Francis
(74) *Attorney, Agent, or Firm* — Hamre, Schumann, Mueller & Larson, P.C.

(57) ABSTRACT

A cone crusher wear liner to crush feed materials such as minerals, rocks, or the like includes a stationary bowl liner. The stationary bowl liner is a downward curvature element with double open ends to allow feed material to be fed thereabove. The stationary bowl liner includes an inner circumferential crushing surface. The inner circumferential crushing surface includes a plurality of crushing protrusions. The wear liner also includes a gyrating mantle liner. The gyrating mantle liner is a downward curvature element with double closed ends, and gyrates at axial axis at an off-set angle to enable the feed materials between a pre-set gap to be crushed to smaller portions by the plurality of crushing protrusions.

7 Claims, 6 Drawing Sheets

(56) References Cited

U.S. PATENT DOCUMENTS

Figure 4:
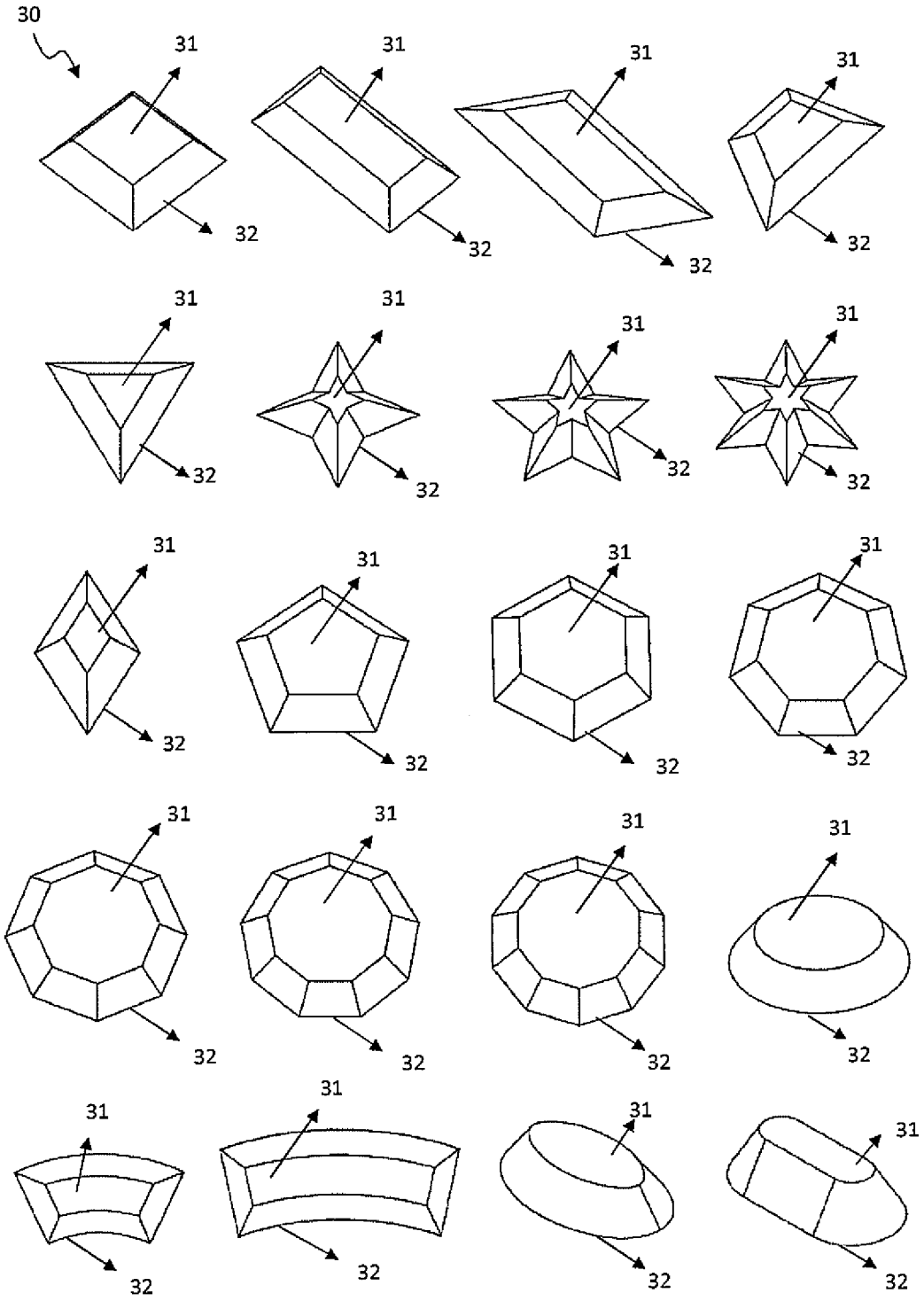

| | | | | |
|---|---|---|---|---|
| 6,315,225 | B1 * | 11/2001 | Karra | B02C 2/04 241/207 |
| 8,020,801 | B2 * | 9/2011 | Eriksson | B02C 2/047 241/207 |
| 8,602,340 | B2 * | 12/2013 | Berton | B02C 2/005 164/91 |
| 2008/0041995 | A1 | 2/2008 | Hall et al. | |
| 2014/0306041 | A1 * | 10/2014 | Belotserkovskiy | B02C 2/04 241/30 |

* cited by examiner

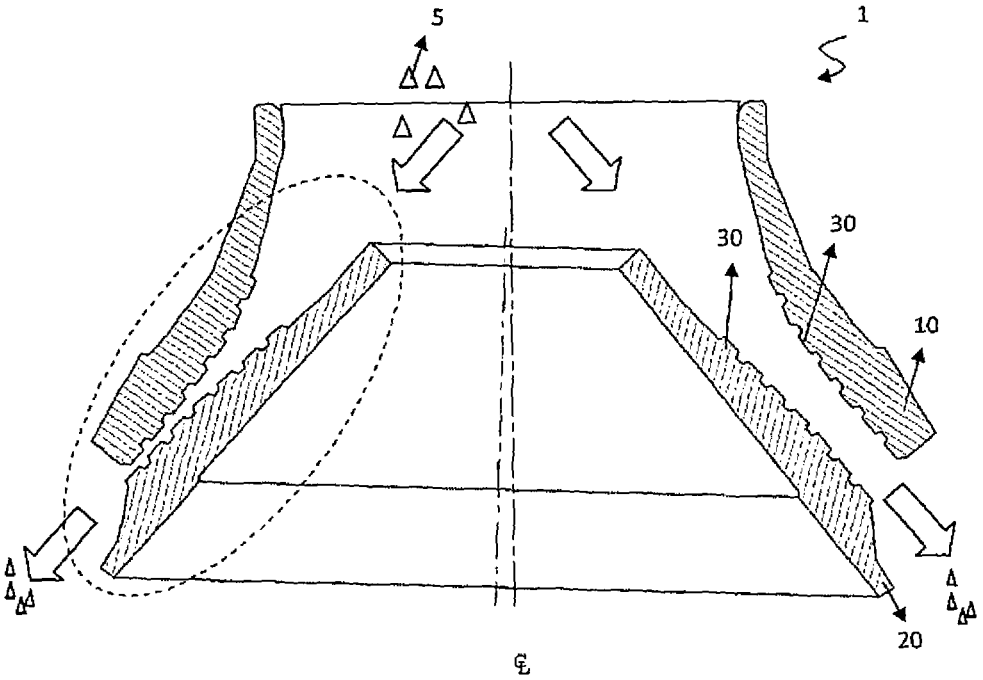
FIG. 1-A
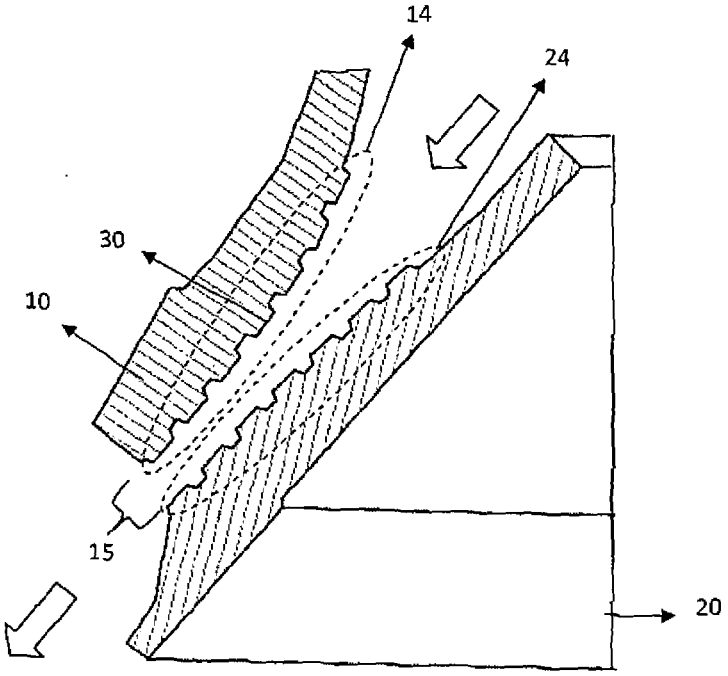
FIG. 1-B

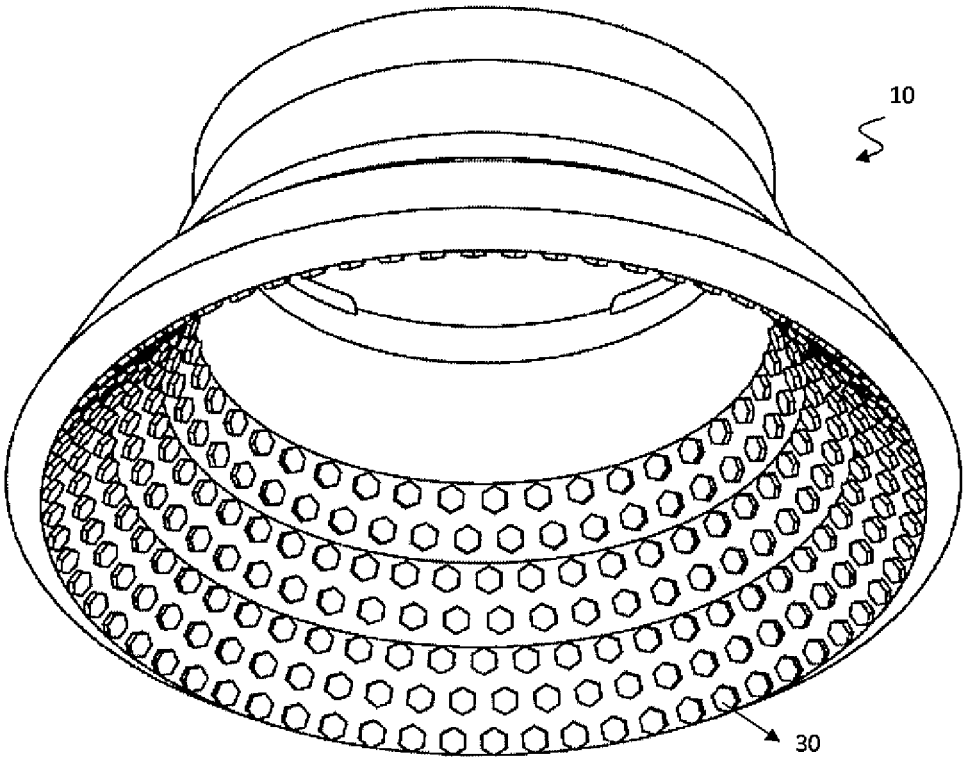
FIG. 1-C

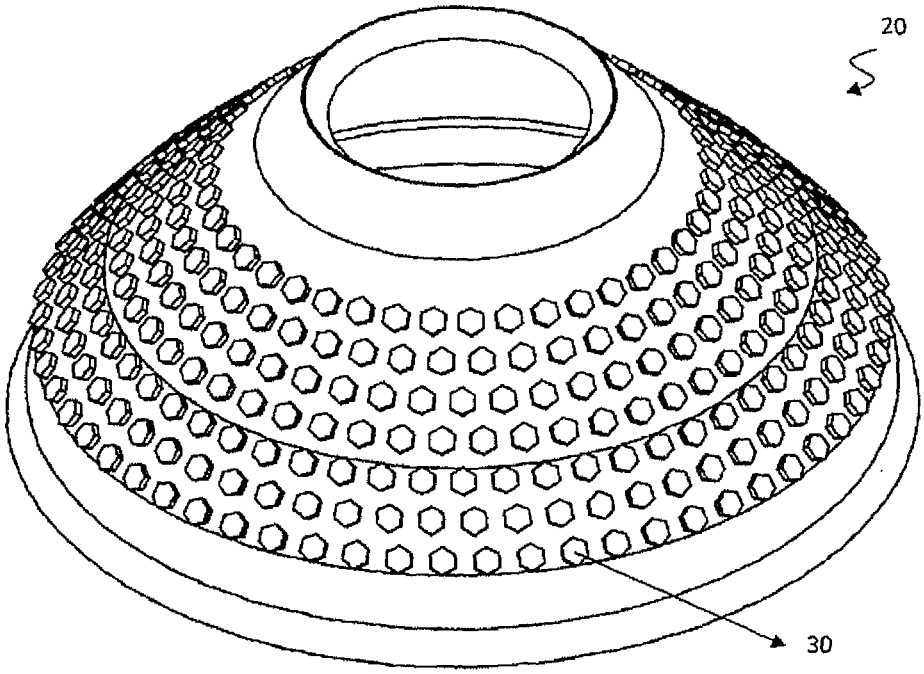
FIG. 1-D
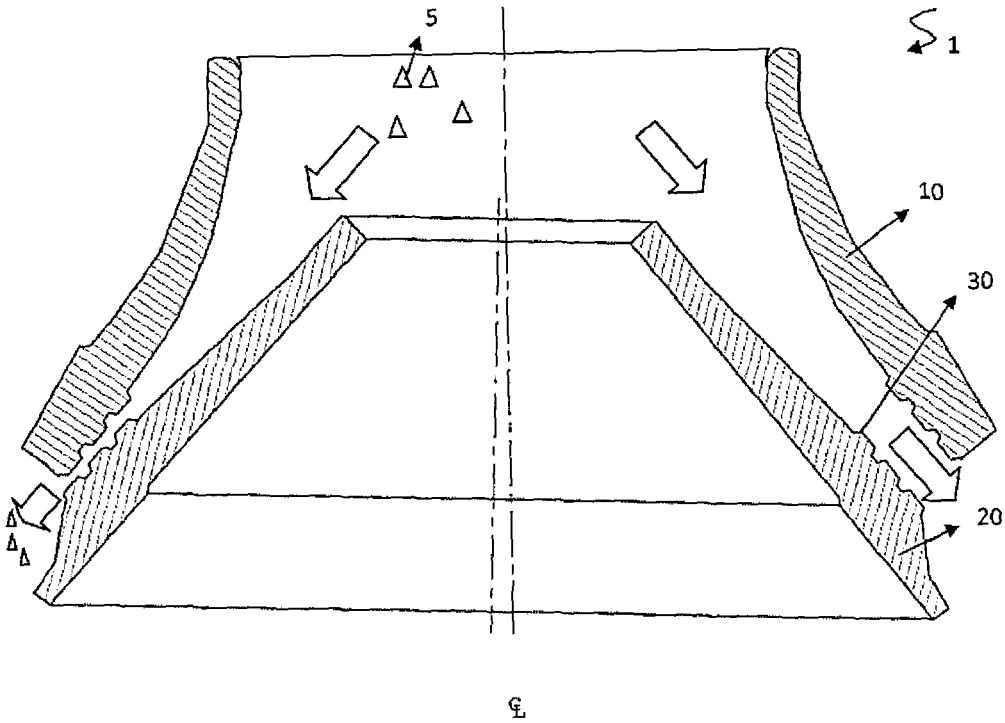
FIG. 2-A

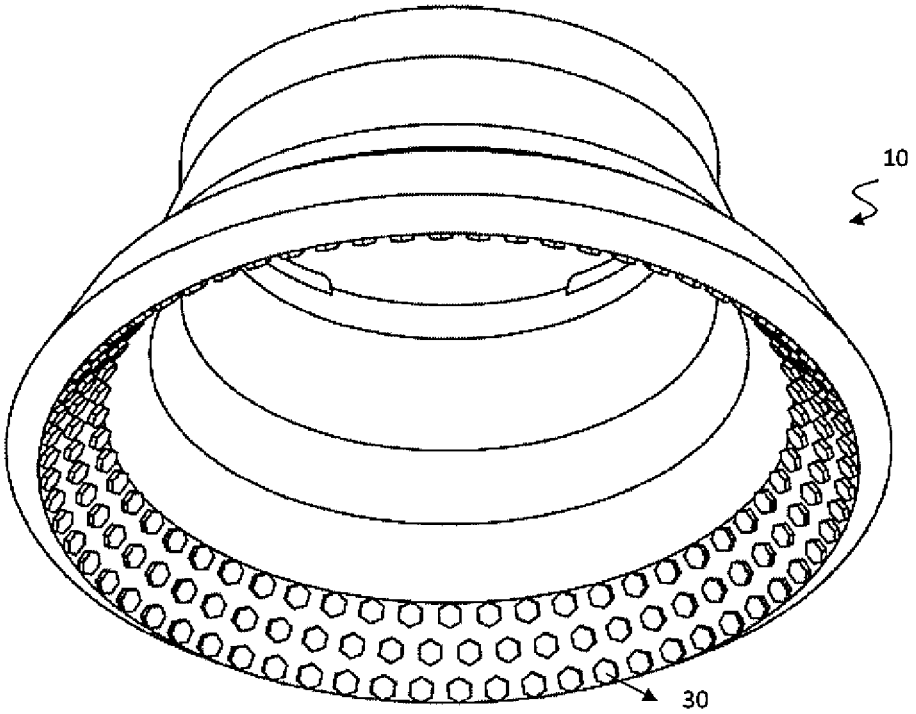
FIG. 2-B
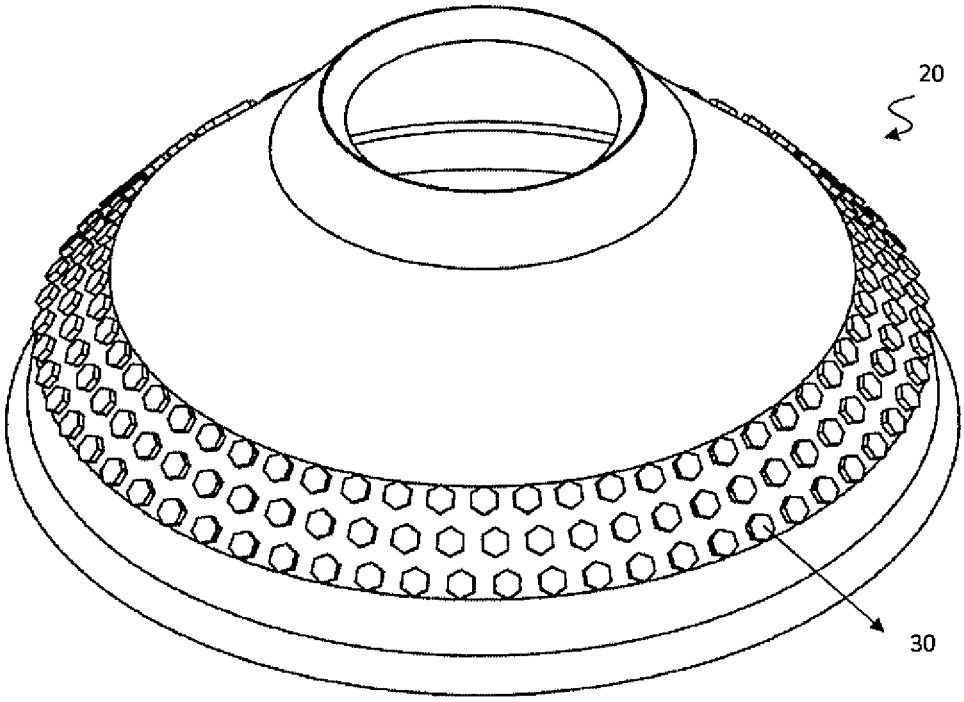
FIG. 2-C

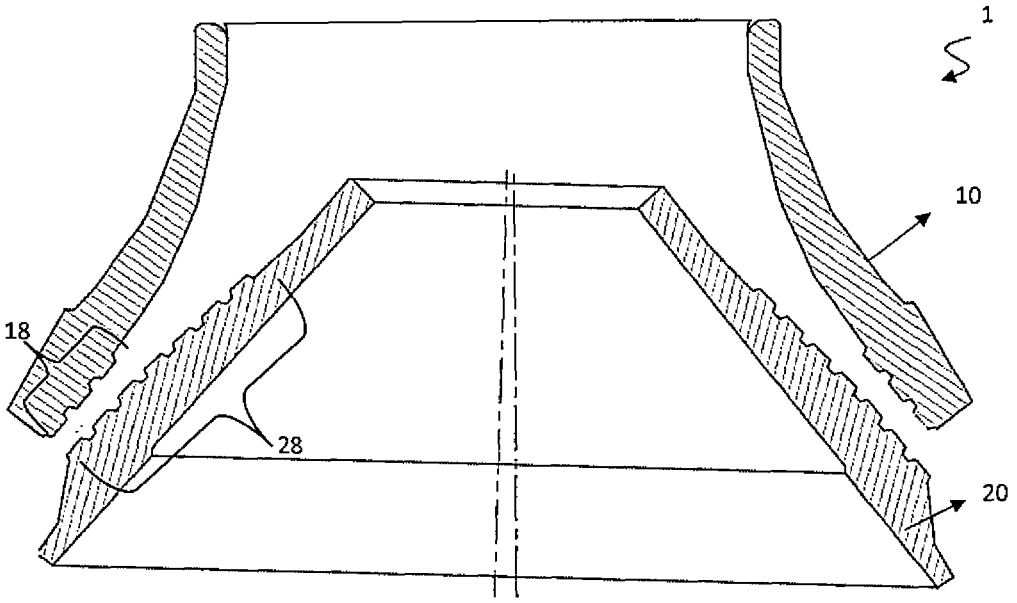
FIG. 3-A
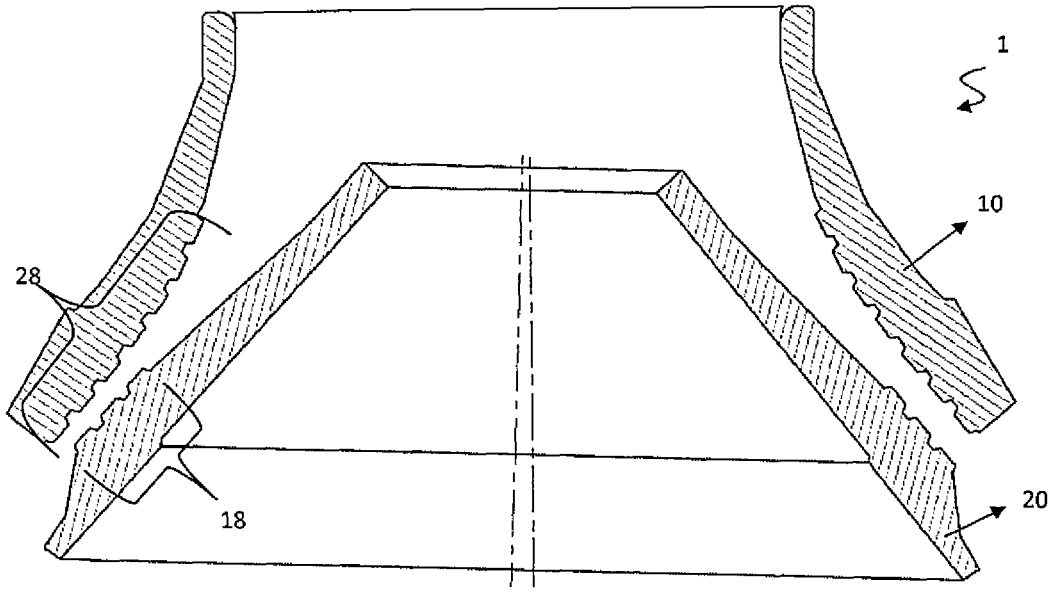
FIG. 3-B

REPLACEMENT CONE CRUSHER WEAR LINERS

1. TECHNICAL FIELD OF THE INVENTION

The present invention relates to a cone crusher wear liner to crush feed materials such as minerals, rocks, or the like, comprising, a stationary bowl liner is a downward curvature element with double open ends, to allow feed material to be fed thereabove, comprising an inner circumferential crushing surface comprising a plurality of crushing protrusions; a gyrating mantle liner is a downward curvature element with double closed ends, gyrating at axial axis displaced at an eccentric angle to enable said feed materials between said pre-set gap to be crushed to a smaller portion by circumferential crushing surfaces of the bowl liner and the mantle liner, both these surfaces covered with said plurality of crushing protrusions.

2. BACKGROUND OF THE INVENTION

Rock, ore (metallic and non-metallic), and waste construction material are usually crushed using cone crushers to have the size of the feed material reduced for downstream processes. The crushing chamber of the cone crusher is formed between the mantle liner and the bowl liner. The mantle liner is the moving part with a gyrating motion eccentrically driven by a motor. The bowl liner is the fixed component and is usually fixed the vertical axis. The crushed product size is determined by the closed side setting (CSS) which is the minimum gap set between the mantle and bowl liner at the exit of the crushing chamber. The mantle and bowl liners are typically made of austenitic manganese steel. Standard grade of austenitic manganese steel, also known as Hadfield steel typically have manganese content of 11 to 14% Mn by weight (typically complies to BS 3100 Grade BW10 or ASTM A128 Grade A/B). Austenitic manganese steel is the primary choice of material for the cone crusher wear liners due to its excellent toughness and its unique behavior to work-harden upon impacting from the crushing forces generated inside the crushing chamber. The extent of work-hardening on the manganese wear liners typically depends on its chemical composition and grain size of the manganese steel, the geological properties of the ore or rocks and the kinetics of the forces inside the crushing chamber. The hardness of manganese steel in its austenitic state ranges between 180-240 BHN (Brinell hardness number) typically. Upon work-hardening, the hardness can reach to 400-500 BHN. The wear life of the crusher wear liners is a function of both the hardness value upon work-hardened and also the rate of work-hardening occurring in the wear liners during the crushing operations. Current supplies of manganese steel for the crushing industry have the manganese content varied to higher percentage (>11-14%) and may have other elements such as chromium, molybdenum, nickel, vanadium, etc. alloyed into steel to vary its physical and mechanical properties aimed at improving the wear life of the mantle and bowl liners. Other methods such as overlaying the crushing surfaces of the wear liners with hard-facing weld deposits, introducing foreign hard wear-resistance inserts (US 2008041995A1 by Hall et al.), arc-weld deposits (U.S. Pat. No. 3,565,354A by D. R. Gittings), inserts onto the crushing surfaces, use of explosives to pre-harden the wear liners have been used with the intention to improve the wear life of the liners (U.S. Pat. No. 2,703,297A by Macleod), or resistance plate (WO 2014072136A2 by Malmqvisk et al.). However, these teachings have their shortcomings such as higher manufacturing material costs of the inserts, hard-facing electrodes, resistance plate, and the labour cost component in adding these features onto the wear liners. Therefore, it is advantageous to have a wear liner that has incorporated cast in protrusions of various shapes (reference FIG. 3) of the present invention that will work-harden more rapidly by the kinetic energy imparted by the crushing forces during the rock or ore crushing process.

3. SUMMARY OF THE INVENTION

Accordingly, it is the primary aim of the present invention to provide a replacement cone crusher wear liner with protrusions capable of enhance work hardening of the wear liners.

It is an object of the present invention to quicken the rate of work hardening of the wear liners.

It is an object of the present invention to provide better cost to benefit and more reliability option as compared to cone crusher liner with inserts type, wear plate type, welding type, or the like.

It is an object of the present invention to provide more safety as compared to cone crusher liner pre-hardening using explosives.

It is an object of the present invention to be produced by method of casting, hot forging, or moulding, or the like.

Additional objects of the invention will become apparent with an understanding of the following detailed description of the invention or upon employment of the invention in actual practice.

According to the preferred embodiment of the present invention the following is provided:

A replacement cone crusher wear liner (1), comprising:

a stationary bowl liner (10) is a downward curvature element with double open ends, to allow feed material (5) to be fed thereabove, comprising an inner circumferential crushing surface (14) comprising a plurality of crushing protrusions (30);

a gyrating mantle liner (20) is a downward curvature element with double closed ends, gyrating at axial axis; motion driven by an electric motor (20);

characterized in that said gyrating mantle liner (20) comprising an outer circumferential crushing surface (24) comprising a plurality of crushing protrusions (30);

said stationary bowl liner (10) is disposed on top of said gyrating mantle liner (20) whereby said inner circumferential crushing surface (14) comprising a plurality of crushing protrusions (30) and said outer circumferential crushing surface (24) comprising a plurality of crushing protrusions (30) which form a pre-set gap (15) or closed side setting;

further characterized in that said mantle liner (20) is gyrating at said axial axis at an off-set angle to enable said feed materials (5) between said pre-set gap (15) to be crushed to a smaller portion by said plurality of crushing protrusions (30) on said inner and outer circumferential surfaces of said bowl liner (10) and said mantle liner (20).

4. BRIEF DESCRIPTION OF THE DRAWINGS

Other aspect of the present invention and their advantages will be discerned after studying the Detailed Description in conjunction with the accompanying drawings in which:

FIG. 1-A shows a cross sectional view of the present invention.

FIG. 1-B shows an enlarged cross sectional view of FIG. 1-A denoted by dotted line region.

FIG. 1-C shows a perspective view of a stationary bowl liner with protrusions of the present invention.

FIG. 1-D shows a perspective view of a gyrating mantle liner with protrusions of the present invention.

FIG. 2-A shows a cross sectional view of another embodiment of the present invention.

FIG. 2-B shows another embodiment of a perspective view of a stationary bowl liner with protrusions of the present invention.

FIG. 2-C shows another embodiment of a perspective view of a gyrating mantle liner with protrusions of the present invention.

FIG. 3-A shows another embodiment of a perspective view of a stationary bowl liner with short chamber protrusions and a gyrating mantle liner with long chamber protrusions.

FIG. 3-B shows another embodiment of a perspective view of a stationary bowl liner with long chamber protrusions and a gyrating mantle liner with short chamber protrusions.

FIG. 4 shows type of protrusions shape of the present invention.

5. DETAILED DESCRIPTION OF THE DRAWINGS

In the following detailed description, numerous specific details are set forth in order to provide a thorough understanding of the invention. However, it will be understood by the person having ordinary skill in the art that the invention may be practiced without these specific details. In other instances, well known methods, procedures and/or components have not been described in detail so as not to obscure the invention.

The invention will be more clearly understood from the following description of the embodiments thereof, given by way of example only with reference to the accompanying drawings, which are not drawn to scale.

The present invention seeks to improve the wear resistant properties/wear life of cone crusher wear liners by inducing a quicker rate of work-hardening and thus a greater extend of work-hardening on the liners during crushing operation. The framework rests on the fact that rate of hardening and the extent of work hardening is a direct function of the kinetic energy imparted onto the liners during the crushing operations.

Upon solutionizing treatment manganese steel retains its austenitic structure due the stabilizing effect of the manganese element in the steel. However, the state of the austenite is metastable and upon the imparting of energy to its structure from the kinetics of the crushing, the steel 'work hardens'. However, certain feed materials fed into the crusher are friable but can be highly abrasive (especially high content of silica or quartzite). In these cases, the extent of work-hardening on the manganese steel liners is low and the work hardened case is very shallow. The shallow lightly hardened case gets worn away before it becomes fully work hardened and resulting in quick wearing of the mantle and bowl liners. The mechanism of work-hardening is quite complex; it is a combination of phase structure transformation of austenite to σ- and ξ-martensite (which is structurally very much harder than austenite), deformation induced mechanical twinning and dynamic strain ageing. All these work hardening mechanisms have to be initiated by the introducing of energy into the steel structure, and this energy comes from the crushing forces inside the crushing chamber. The extent of deformation or strain in the steel structure is a direct function of the amount of stress introduced onto the wear liners.

Stress (σ) is defined as the force per unit area;

$$\sigma = F/A \quad \text{(Eq. 1)}$$

where, σ=stress ($N/m^2$), correct, Newton per Meter square

F=force component (N),

A=area of the applied force ($m^2$)

Strain (ξ) is defined as the deformation of a solid due to stress. As stress (σ) and strain (ξ) are inversely related to the area of the applied force; at a given value of the force F acting during the crushing, the stress generated would be greater if the surface area is reduced. The amount of strain would similarly be greater given a higher value induced stress.

As for mechanical twinning to occur, the energy imparted onto the wear liners must exceed that of the stacking fault energy which is typically in the range of 18-35 $mJ/m^2$.

Therefore, it is the intended to increase the stress and strain induced on the wear liners by reducing the contact surface area with the forces of the crushing operations. This is achieved by introducing raised pads or protrusions formed from the same parent material as the wear liners (manganese steel in this case); the raised pads or protrusions to be shaped such that the top surface is smaller than the base surface. These pads are positioned with gaps or recesses between them to facilitate the flow of fine material and to accommodate any 'growth' of the manganese steel due to its high plasticity. By introducing these raised pads or protrusions, the surface area in contact with the crushing medium would be reduced compared to a smooth crushing surface on the wear liners. For example, a reduction of 30% on the surface area of contact during crushing would increase the stress induced on the liners by 42.8%. Based on the understanding that the extent and rate of work-hardening is directly proportional to the stress/strain induced onto the liners, the higher stress/strain induced onto the liners would promote a quicker rate of work-hardening on the liners. The depth of the work-hardened case and the hardness value would be increased and this translates into improved wear resistance of the manganese steel wear liners.

Referring to FIGS. 1-A to 2-C, there are shown the present invention (1) of replacement cone crusher wear liner whereby stationary bowl liner (10) is a downward curvature element with double open ends, the top open end allows feed material (5) such as rock, ore, mineral, or metallic material, organic, inorganic, or a combination thereof, to be fed thereabove demarcated by block arrows, the stationary bowl liner (10) comprising an inner circumferential crushing surface (14) further comprising a plurality of crushing protrusions (30). A gyrating mantle liner (20) is a downward curvature element with double closed ends, gyrating at its axial axis, comprising an outer circumferential crushing surface (24) comprising a plurality of crushing protrusions (30). The mantle liner (20) is gyrated at an offset to its axial axis by an eccentric transmission, driven by an electric motor. The stationary bowl liner (10) is disposed on top of said gyrating mantle liner (20) whereby said inner circumferential crushing surface (14) comprising a plurality of crushing protrusions (30) and said outer circumferential crushing surface (24) comprising a plurality of crushing protrusions (30) which form a pre-set gap (15) or close set setting (CSS) which is the minimum gap between the bowl liner and mantle liner at the exit of the crushing chamber.

The stationary bowl liner (10) and gyrating mantle liner (20) are preferably made of austenitic high manganese steel whereby manganese content is higher than 11% by weight.

Refer to FIGS. 1-A (long chamber protrusions padded version) and 2-A (short chamber protrusions padded version), the selected version for application very much depends on crusher design profile, the abrasiveness/wear properties of the crushing medium and the specific operating parameters of each crushing operations.

In cases of enhancing and accelerating the work hardening of the replacement cone crusher wear liner (1), referring now to FIGS. 3-A and 3-B there are shown other embodiments to achieve the objective. The stationary bowl liner (10) with short chamber protrusions (18) couples with a gyrating mantle liner (20) with long chamber protrusions (28), or a stationary bowl liner (10) with long chamber protrusions (28) couples with a gyrating mantle liner (20) with short chamber protrusions (18). The stationary bowl liner (10) can couple with the gyrating mantle liner (20), wherein the liners (10, 20) having short chamber protrusions (18) or long chamber protrusions (28), or a combination thereof.

Referring now to FIG. 4, the protrusions (30) are polygons such as triangle, rectangle, parallelogram, diamond, pentagon, hexagon, heptagon, octagon, nonagon, decagon, trapezium or the like, star-shaped, circle-shaped, oval-shaped, curvilinear-shaped, or rectilinear-shaped, or a combination thereof. The protrusions (30) comprising a top surface (31) and a base surface (32) whereby said base surface (32) has the same shape and larger surface area than said top surface (31).

As described supra, our findings has revealed that small top surface with small surface area produces large amount of stress force (Eq. 1) and strain which enhance the hardness (upon work hardening) and rate of the work hardening of the liners (10,20). The replacement cone crusher wear liner (1) is preferably made of austenitic high manganese steel with Mn content higher than 11% in weight, and formed by casting, moulding, or hot-forged method.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

What is claimed is:

1. A cone crusher apparatus, comprising:

a stationary bowl liner, the stationary bowl liner is a downward curvature element with double open ends to allow feed material to be fed thereabove, the stationary bowl liner includes an inner circumferential crushing surface having a first plurality of crushing protrusions, the first plurality of crushing protrusions is integrally formed as raised pads of the inner circumferential crushing surface and separated by gaps; and a gyrating mantle liner, the gyrating mantle liner is a downward curvature element with double closed ends, the gyrating mantle liner is configured to gyrate at an axial axis, the gyrating mantle liner is driven by an electric motor, wherein said gyrating mantle liner includes an outer circumferential crushing surface having a second plurality of crushing protrusions, the second plurality of crushing protrusions is integrally formed as raised pads of the outer circumferential crushing surface and separated by gaps, said stationary bowl liner is disposed on top of said gyrating mantle liner, and said first plurality of crushing protrusions and said second plurality of crushing protrusions form a pre-set gap or closed side setting, said gyrating mantle liner is configured to gyrate at said axial axis at an off-set angle to enable said feed materials between said pre-set gap to be crushed to smaller portions by said first plurality of crushing protrusions and said second plurality of crushing protrusions, said stationary bowl liner and said gyrating mantle liner are formed from manganese steel, and said first plurality of crushing protrusions and said second plurality of crushing protrusions are formed from the same manganese steel from which the stationary bowl liner and the gyrating mantle liner are formed.

2. The cone crusher apparatus as claimed in claim 1, wherein the stationary bowl liner, the gyrating mantle liner, the first plurality of crushing protrusions, and the second plurality of crushing protrusions are made of austenitic high manganese steel whereby a manganese content is higher than 11% by weight.

3. The cone crusher apparatus as claimed in claim 1, wherein said first plurality of crushing protrusions and said second plurality of crushing protrusions are polygons, star-shaped, curvilinear-shaped, or rectilinear-shaped, or a combination thereof.

4. The cone crusher apparatus as claimed in claim 3, wherein said first plurality of crushing protrusions and said second plurality of crushing protrusions include a top surface and a base surface whereby said base surface has the same shape and a larger surface area than said top surface.

5. The cone crusher apparatus as claimed in claim 1, wherein said cone crusher apparatus is formed by casting, moulding, or hot-forged method.

6. The cone crusher apparatus as claimed in claim 1, wherein said feed materials are organic, inorganic, rock, mineral, or metallic material, or a combination thereof.

7. The cone crusher apparatus as claimed in claim 1, wherein said stationary bowl liner couples with said gyrating mantle liner, wherein said stationary bowl liner and said gyrating mantle liner have chamber protrusions with a first length or chamber protrusions with a second length, or a combination thereof, wherein the second length is longer than the first length.

* * * * *